US009187853B2

(12) United States Patent
Lee

(10) Patent No.: US 9,187,853 B2
(45) Date of Patent: Nov. 17, 2015

(54) SEWING MACHINE AND METHOD OF CONTROLLING OPERATION OF THE SAME

(75) Inventor: Dong Gyu Lee, Incheon (KR)

(73) Assignee: SUNSTAR CO., LTD., Incheon (KR)

( * ) Notice: Subject to any disclaimer, the term of this patent is extended or adjusted under 35 U.S.C. 154(b) by 958 days.

(21) Appl. No.: 13/313,197

(22) Filed: Dec. 7, 2011

(65) Prior Publication Data

US 2012/0145061 A1 Jun. 14, 2012

(30) Foreign Application Priority Data

Dec. 8, 2010 (KR) ..... 10-2010-0124829
Jul. 13, 2011 (KR) ..... 10-2011-0069517

(51) Int. Cl.
*D05B 1/00* (2006.01)
*D05B 15/00* (2006.01)
*D05B 23/00* (2006.01)
*D05B 21/00* (2006.01)

(52) U.S. Cl.
CPC ..... *D05B 15/00* (2013.01); *D05B 21/00* (2013.01); *D05B 23/00* (2013.01)

(58) Field of Classification Search
CPC ..... D05B 23/00
USPC ..... 112/475.04, 14, 470.05, 470.06, 112/470.13, 470.17, 220, 80.4, 102.5
See application file for complete search history.

(56) References Cited

U.S. PATENT DOCUMENTS

| | | | | |
|---|---|---|---|---|
| 2,864,327 | A * | 12/1958 | Cole et al. | 112/470.13 |
| 4,593,636 | A * | 6/1986 | Schips | 112/308 |
| 4,601,249 | A * | 7/1986 | Frye | 112/470.13 |
| 5,529,004 | A * | 6/1996 | Porter et al. | 112/470.03 |
| 5,642,679 | A * | 7/1997 | Monget et al. | 112/470.13 |
| 5,647,292 | A * | 7/1997 | Morgulis et al. | 112/470.17 |
| 5,647,293 | A * | 7/1997 | Price et al. | 112/470.17 |
| 5,743,200 | A * | 4/1998 | Miller et al. | 112/80.01 |
| 6,189,470 | B1 * | 2/2001 | Root et al. | 112/470.13 |
| 6,792,884 | B1 * | 9/2004 | Barrus | 112/475.08 |
| 7,444,951 | B2 * | 11/2008 | Ishikawa et al. | 112/475.04 |
| 7,578,249 | B2 * | 8/2009 | Morgante et al. | 112/80.01 |

* cited by examiner

*Primary Examiner* — Tejash Patel
(74) *Attorney, Agent, or Firm* — LRK Patent Law Firm

(57) ABSTRACT

A head unit fixed sewing machine is provided, which includes a table, support posts, an upper beam, a head unit and a bed unit. An object is placed on the table. The support posts are provided on opposite sides of the table. The upper beam connects the support posts to each other and is coupled to upper ends of the support posts. The head unit is fastened to the upper beam and has a head-unit-rotating means for rotating a sewing head within a predetermined range. The bed unit is provided below the head unit and has a bed-unit-rotating means for rotating a sewing bed within a predetermined range. Because the head unit and the bed unit can be rotated while sewing, the orientation of a sewn thread can be maintained constant. Hence, a perfect stitch can be realized over the entirety of the object.

30 Claims, 18 Drawing Sheets

SEWING MACHINE AND METHOD OF CONTROLLING OPERATION OF THE SAME

CROSS REFERENCE TO RELATED APPLICATIONS

This application claims the benefit under 35 U.S.C. 119(a) of Korean Patent Application Nos. 10-2010-0124829, filed on Dec. 8, 2010, and 10-2011-0069517, filed on Jul. 13, 2011, the disclosure of each of which is incorporated by reference in its entirety for all purposes.

BACKGROUND OF THE INVENTION

1. Field of the Invention

The present invention relates generally to sewing machines having rotatable sewing heads and methods of controlling the operation of the sewing machines and, more particularly, to a sewing machine which is configured such that a sewing head rotates when an object, such as an airbag, a bag, a shoe, etc., is being sewn so that the sewing operation can be satisfactorily conducted without causing a hitch stitch, and in which a plurality of sewing heads may be arranged on a front surface of an upper beam in a row or, alternatively, a plurality of groups of sewing heads may be provided so as to be independently operable on individual work areas, so that not only the quality of the products can be enhanced but also the productivity can be markedly enhanced, and a method of controlling the operation of the sewing machine.

2. Description of the Related Art

Generally, objects, such as airbags, bags, shoes, etc., are made of comparatively thick materials and have many sewing lines, such as circular, curved, slanted lines, etc., which are difficult to sew. Thus, in the case of conventional sewing machines, hitch stitches were easily formed with respect to a correct sewing direction. Such hitch stitches make the entire stitch shape uneven, thus deteriorating the quality of the product.

FIG. 1 illustrates an embodiment of a conventional sewing machine. In the conventional sewing machine, an arm part 40 having a head unit is disposed on a table 10. A bed unit (not shown) having a hook is disposed under the table 10. A connection unit 60 connects the arm part 40 to the bed unit. An object that is supported by a sewing frame 50 is sewn by interaction between the head unit and the hook of the bed unit.

In the sewing machine having the above construction, the sewing frame 50 can be moved in an X-axis or Y-axis direction by the arm-bed structure, thus making it possible to sew a limited area of an object.

However, in the conventional sewing machine, the sewing frame 50 linearly moves in the X-axis or Y-axis direction. Therefore, when the sewing machine forms a curved, circular or slanted stitch line, hitch stitches are caused in some sections.

FIGS. 2A through 2C are views showing examples of hitch stitches caused in the conventional sewing machine. In the case of a rhombic or rectangular shape, two sides of the four sides were P (Perfect stitch) sections, another side was an H/P (Hitch/Perfect stitch) section where there are normal stitches and abnormal stitches together, and the other side was an H (Hitch stitch) section.

FIG. 2C is an H-P stitch distribution chart by section after sewing. In the case of a circular stitch section, a P (Perfect stitch) section and an H (Hitch stitch) section were in a ratio of almost 1:1:

Therefore, a sewing machine which can realize perfect stitching over the entire section is required in order for the quality of the sewing to be high quality.

Furthermore, the conventional sewing machine cannot process a comparatively large object because the sewing area of the sewing machine is restrictive. To solve this problem, it is required to increase the size of the sewing machine. As a result, a new concept is needed for a sewing machine so that the space required to install a large sewing machine can be minimized.

In addition, the conventional sewing machine can process only one object at a time. Thus, it takes too long to process a large number of objects. Therefore, to enhance the productivity, a sewing machine which can process a plurality of objects at a time is needed.

SUMMARY OF THE INVENTION

Accordingly, the present invention has been made keeping in mind the above problems occurring in the prior art, and an object of the present invention is to provide a sewing machine which can realize a perfect stitch over the entirety of an object even when sewing an object such as an airbag, a bag, a shoe, etc., that are thick materials and have sewing lines which are difficult to sew, thus markedly enhancing the quality of the product.

Another object of the present invention is to provide a sewing machine which although small in size can sew a comparatively large object, thus minimizing the installation space of the sewing machine.

A further object of the present invention is to provide a sewing machine which has a plurality of work areas so that the operation of sewing a plurality of objects can be continuously conducted without requiring a separate object replacing operation.

Yet another object of the present invention is to provide a sewing machine which can process a plurality of objects at a time, thus markedly enhancing productivity.

Still another object of the present invention is to provide a sewing machine which is configured such that when sewing a plurality of objects, the sewing machine reads information about the objects and conducts the sewing operation according to the read information.

Still another object of the present invention is to provide a method of controlling the operation of the sewing machine in which the head unit and the bed unit are rotated while sewing so that even when an object such as an airbag, a bag, a shoe, etc. is being sewn, a perfect stitch can be realized over the entirety of the object.

In order to accomplish the above object, the present invention provides a sewing machine, including: a table, on which an object to be sewn is placed; support posts provided on opposite sides of the table; an upper beam connecting the support posts to each other, the upper beam being coupled to upper ends of the support posts; a head unit fastened to the upper beam, the head unit having head-unit-rotating means for rotating a sewing head within a predetermined range; and a bed unit provided below the head unit, the bed unit having bed-unit-rotating means for rotating a sewing bed within a predetermined range.

The head-unit-rotating means may include a rotating motor used as a power source; a power transmission unit connected to a drive shaft of a rotating motor, the power transmission unit transmitting a drive force of the rotating motor; a driven shaft rotated by the drive force of the rotating motor transmitted by the power transmission unit; and a sewing head provided on the driven shaft, the sewing head being rotated around the driven shaft.

The power transmission unit may comprise a rotating drive gear reducing an rpm of the rotating motor and transmitting the drive force to the driven shaft at a reduced rpm.

The rotating drive gear may comprise a bevel gear configured such that the drive shaft is at a right angle to the driven shaft.

The bed-unit-rotating means may include: a rotating motor used as a power source; a power transmission unit connected to a drive shaft of a rotating motor, the power transmission unit transmitting a drive force of the rotating motor; a driven shaft rotated by the drive force of the rotating motor transmitted by the power transmission unit; and the sewing bed provided on the driven shaft.

The power transmission unit may comprise a rotating drive gear reducing an rpm of the rotating motor and transmitting the drive force to the driven shaft at a reduced rpm.

The rotating drive gear may comprise a bevel gear configured such that the drive shaft is at a right angle to the driven shaft.

Furthermore, a momentum of a rotating motor of the bed-unit-rotating means may be synchronized with a rotating motor of the head-unit-rotating means so that the rotating motors are operated together.

The sewing machine may further include: a sewing frame holding the object; an X-axial transport means for transporting the sewing frame in an X-axis direction; and a Y-axial transport means for transporting the sewing frame in a Y-axis direction.

The X-axial transport means may include: an X-axial transport motor providing a drive force; a power transmission means for transmitting the drive force of the X-axial transport motor; a transport bracket connected to the power transmission means, the transport bracket being reciprocated in a horizontal direction by operation of the power transmission means, with the sewing frame fastened to a front surface of the transport bracket; and a guide rail coupled to the transport bracket so that the transport bracket is able to move horizontally on an X-axial frame.

The Y-axial transport means may include: a Y-axial frame extending a predetermined length in the Y-axis direction; a guide rail unit provided on the Y-axial frame; a support unit transporting the sewing frame along the guide rail unit in the Y-axis direction; a Y-axial transport motor providing a drive force to transport the support unit along the guide rail unit in the Y-axis direction; and a transport shaft transmitting the drive force of the Y-axial transport motor to the support unit.

The X-axial transport means may include: an X-axial linear motor providing a drive force to transport the sewing frame on an X-axial frame in the X-axis direction; and a transport bracket reciprocated in the X-axis direction by the drive force of the X-axial linear motor, with the sewing frame fastened to a front surface of the transport bracket.

The Y-axial transport means may include: a Y-axial frame extending a predetermined length in the Y-axis direction; a Y-axial linear motor provided on the Y-axial frame, the Y-axial linear motor providing a drive force to transport the sewing frame in the Y-axis direction; and a support unit transporting the sewing frame in the Y-axis direction in response to operation of the Y-axial linear motor.

The sewing machine may further include a head-unit-lift means provided between the head unit and the upper beam, the head-unit-lift means moving the sewing head upwards and downwards between a stand-by position and a work position.

The head-unit-lift means may further include: a lift actuator installed in a main body of the sewing machine by an actuator support bracket, the lift actuator providing a drive force to move the sewing head upwards or downwards; and a lift plate coupled at a central portion of a front surface thereof to the sewing head, the lift plate being coupled on an upper end of a rear surface thereof to a head unit connection bracket connected to a drive part of the lift actuator, with guide means mounted to opposite sides of the rear surface of the lift plate.

The head-unit-lift means may further include: a support plate coupled on opposite sides of a front surface thereof to the guide means, with an actuator support bracket mounted to a central portion of a rear surface of the support plate, the actuator support bracket supporting the lift actuator thereon.

The head unit may comprise a plurality of head units arranged in a row on the upper beam. The bed unit may comprise a plurality of bed units arranged in such a way as to correspond to the respective head units. A plurality of objects may be held by a single sewing frame on the table so that a plurality of sewing operations are able to be conducted simultaneously.

The sewing machine may further include: X-axial transport means for transporting the sewing frame in the X-axis direction; and Y-axial transport means for transporting the sewing frame in the Y-axis direction.

The head unit may comprise a plurality of groups of head units provided on the upper beam, the plurality of groups of head units being independently operable. The bed unit may comprise a plurality of groups of bed units arranged in such a way as to correspond to the respective head units. The sewing frame may comprise a plurality of sewing frames provided on the table so that the head units are able to independently conduct sewing operations on individual areas.

The sewing frame may include a plurality of sewing work areas, and objects are supported on the respective sewing work areas.

The sewing frame may comprise a plurality of subsidiary sewing frames provided on the single sewing frame so as to be individually removable therefrom.

In addition, an indication may be provided on the sewing frame, the indication containing information instructing about a working method, and a reading means for scanning the indication may be provided on the head unit. The reading means may read the information contained in the indication and transmit the information to a control unit.

The indication may comprise a barcode, and the reading means may comprise a barcode reader.

In order to accomplish the above object, the present invention provides a method of controlling operation of a sewing machine that transports a sewing frame, holding an object to be sewed, in an X-axis or Y-axis direction and rotates a head unit and a bed unit around a Z-axis while sewing, the method including: (a) positioning a sewing needle of the head unit above a needle plate; (b) operating an X-axial transport motor, a Y-axial transport motor, a head unit rotating motor and a bed unit rotating motor in response to information input to a control unit; (c) moving the sewing needle downwards by operation of an upper shaft drive motor and a lower shaft drive motor to form a stitch, and returning to (b) operating when the sewing needle is moved upwards and positioned above the needle plate, and repeating (b) operating and (c) moving.

Furthermore, an rpm of the upper shaft drive motor and an rpm of the lower shaft drive motor may be increased or reduced in proportion to rpms of the X-axial transport motor, the Y-axial transport motor, the head unit rotating motor and the bed unit rotating motor.

After the rpm of the upper shaft drive motor and the rpm of the lower shaft drive motor are reduced, the head unit rotating motor and the bed unit rotating motor may be operated.

The rotating speed of the upper shaft drive motor and the rotating speed of the lower shaft drive motor may be controlled in response to an angle at which the head unit and the bed unit rotate.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, embodiments of a sewing machine and a method of operating the sewing machine according to the present invention will be described in detail with reference to the attached drawings.

Figure 1:
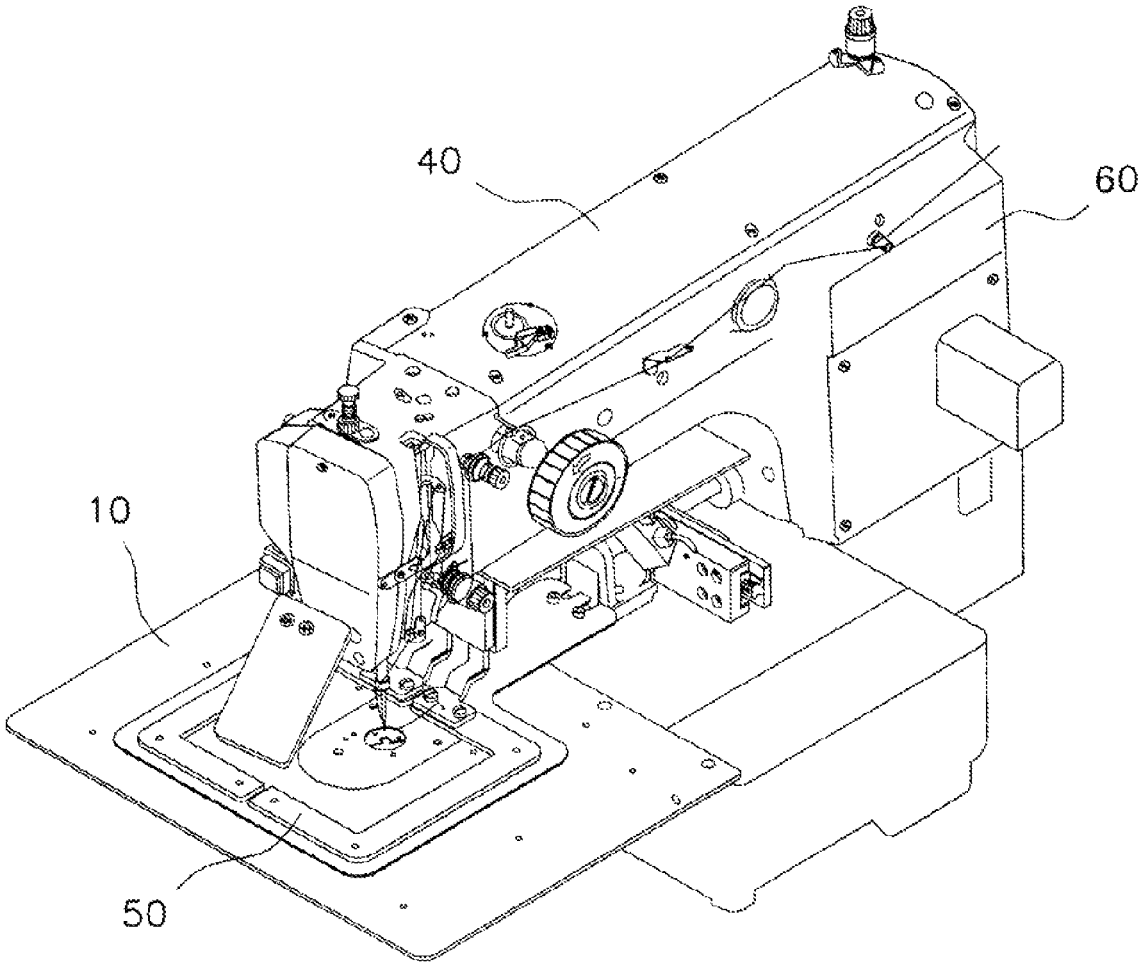
FIG. 1 RELATED ART
FIG. 1 is a perspective view showing an embodiment of a conventional sewing machine.
Figure 2A:
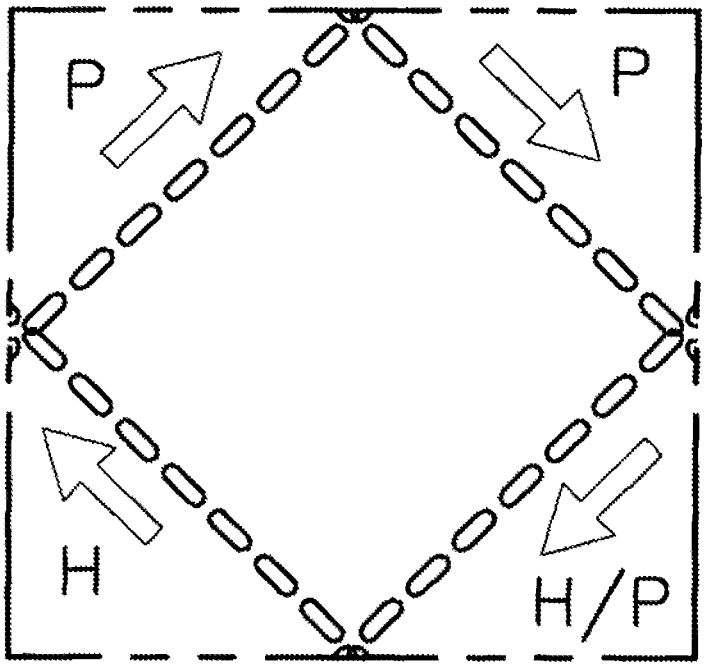
FIG. 2A RELATED ART
FIGS. 2A and 2B are views showing examples of hitch stitches caused by the conventional sewing machine.
Figure 2B:
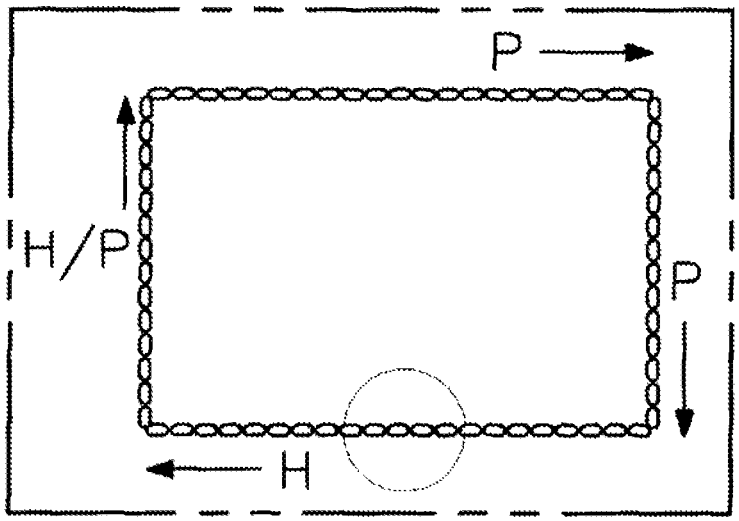
FIG. 2B RELATED ART
Figure 2C:
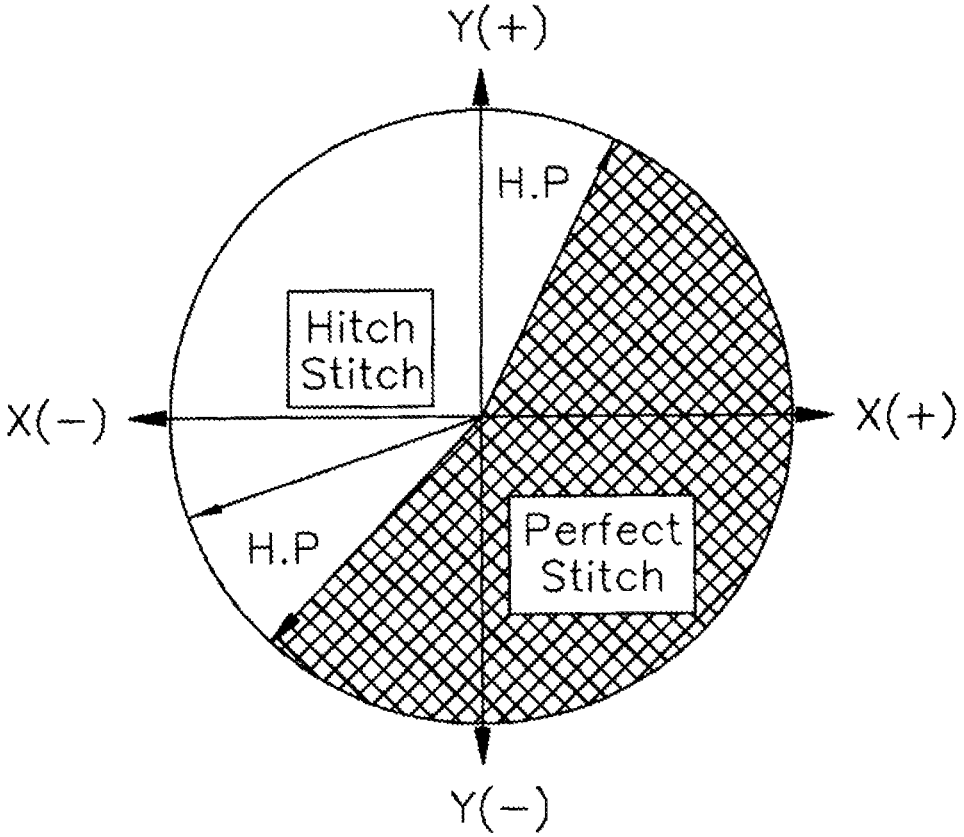
FIG. 2C RELATED ART
FIG. 2C is a view showing H-P stitch distribution per section after sewing.
Figure 3:
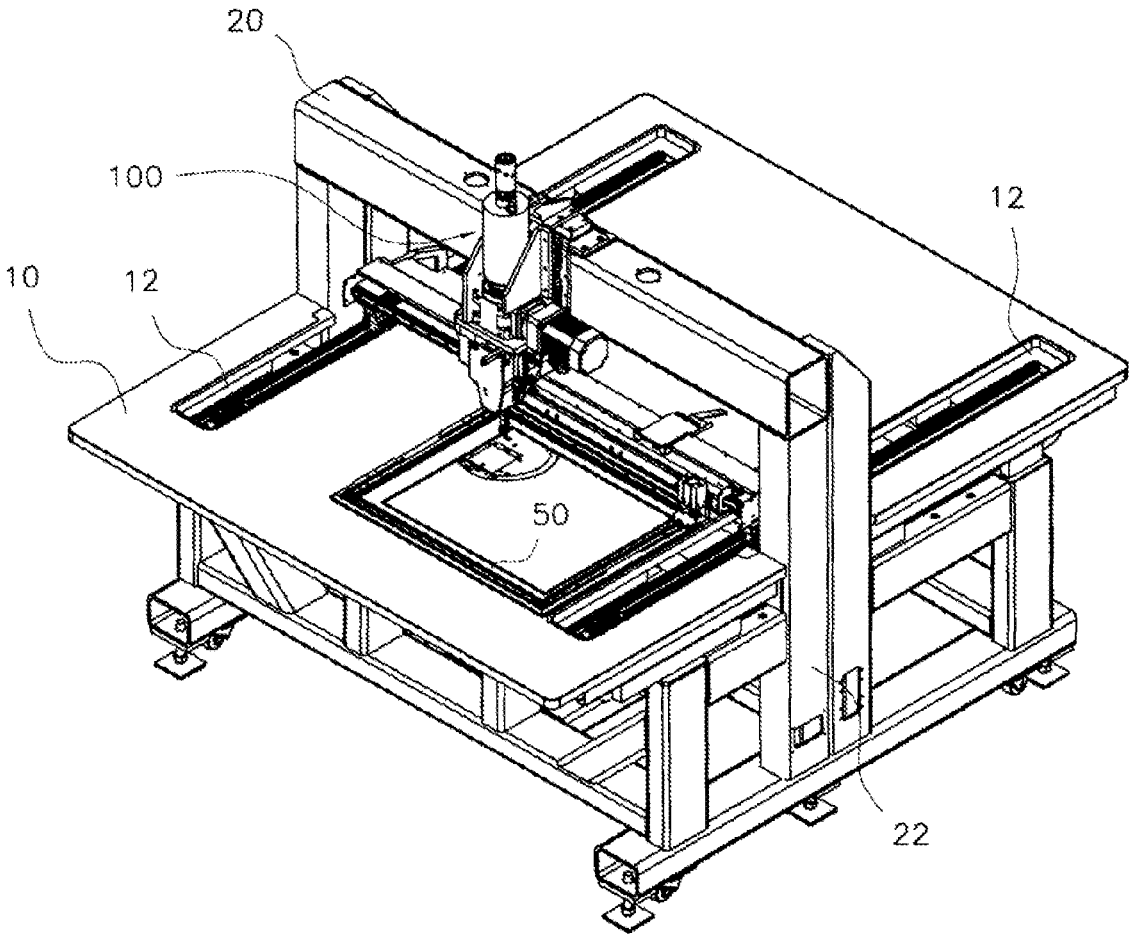
FIG. 3 illustrates a first embodiment of the present invention, showing a perspective view of a sewing machine with a fixed head unit.
Figure 4:
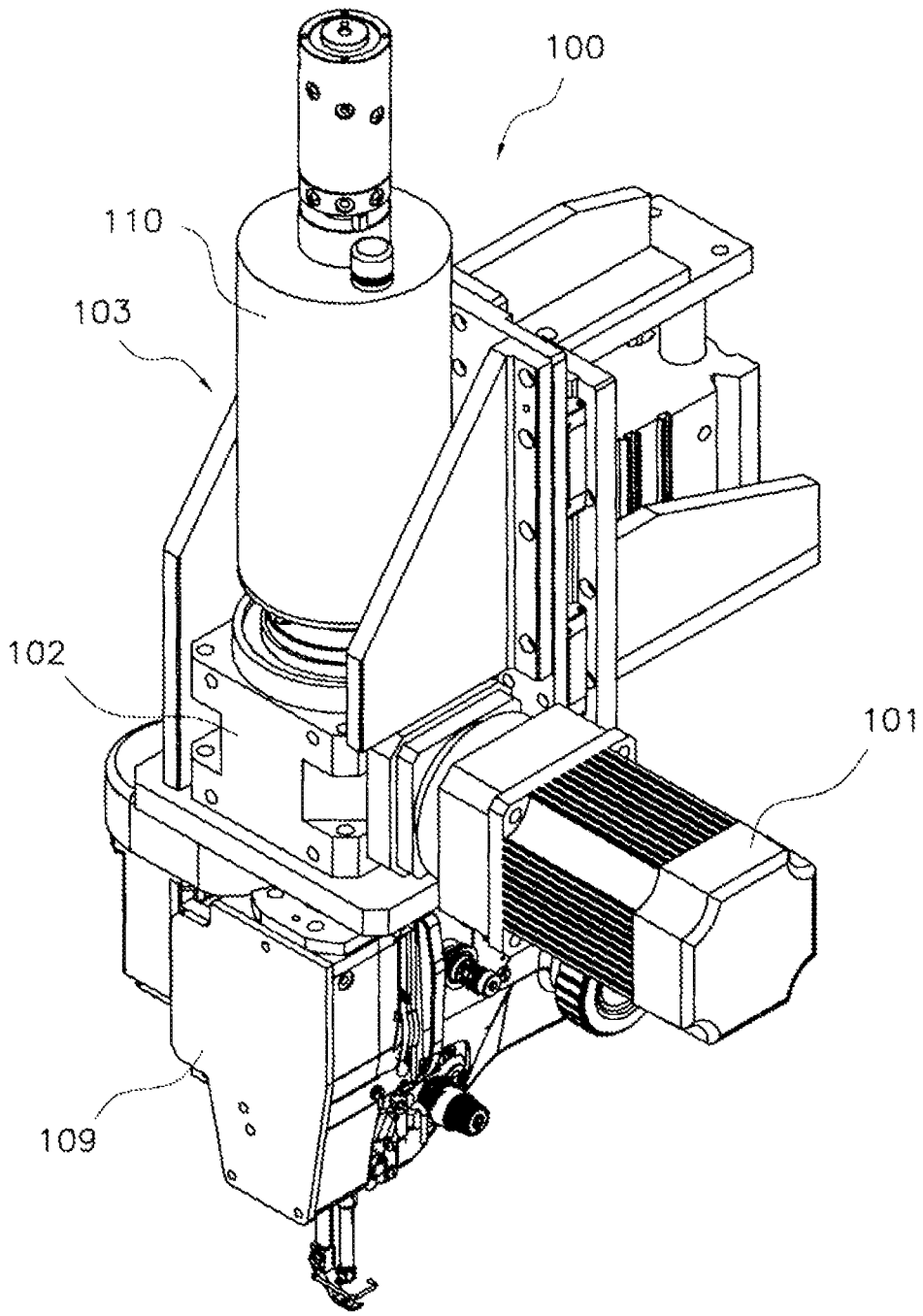
FIG. 4 is a perspective view illustrating a head unit according to the present invention.
Figure 5:
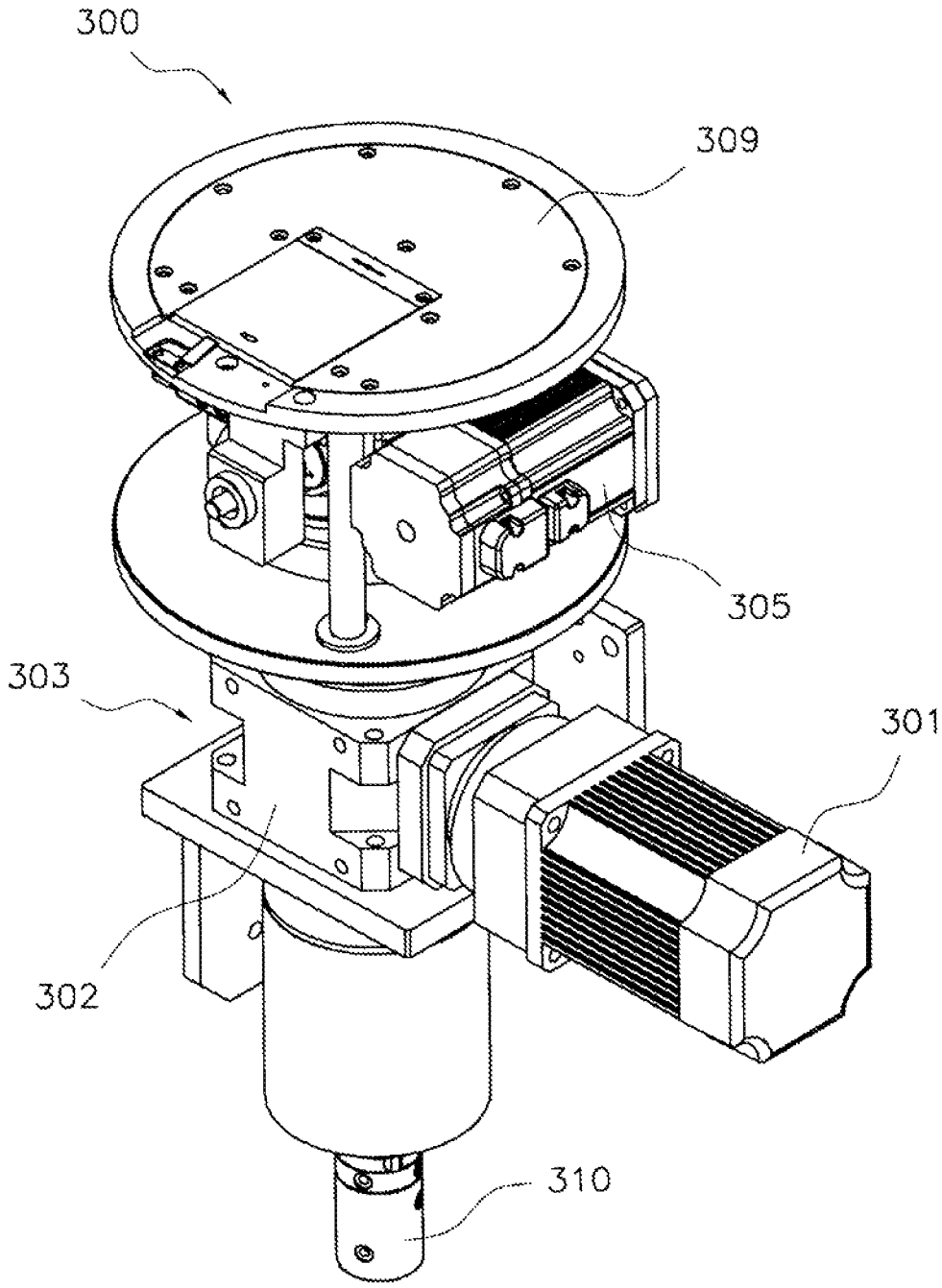
FIG. 5 is a perspective view illustrating a bed unit according to the present invention.

FIG. 3 is a perspective view of a head unit fixed sewing machine according to a first embodiment of the present invention. FIG. 4 is a perspective view illustrating a head unit according to the present invention. FIG. 5 is a perspective view illustrating a bed unit according to the present invention.

In the head unit fixed sewing machine according to the present invention, the head unit 100 is disposed above a table 10. The head unit 100 sews an object which is supported by a sewing frame 50.

The table 10 is a rectangular plate onto which the object to be sewn is placed. Guide slots 12, which extend forwards and rearwards, are respectively formed in opposite sides of the table 10. The guide slots 12 are elongated holes, through which movement of a Y-axis transport means provided under the table 10 is transmitted to the sewing frame 50 provided on the table 10.

Support posts 22 which are placed upright are provided on the opposite sides of the table 10. An upper beam 20 is horizontally connected between upper ends of the support posts 22.

The upper beam 20 is preferably made of a rectangular steel pipe. The head unit 100 is coupled to a medial portion of a front surface of the upper beam 20. A head-unit-lift means 210 is provided between the head unit 100 and the upper beam 20. The head-unit-lift means 210 moves a sewing head 109, provided with a sewing needle which reciprocates in the vertical direction, downwards to a work position or moves the sewing head 109 upwards a stand-by position.

Figure 6:
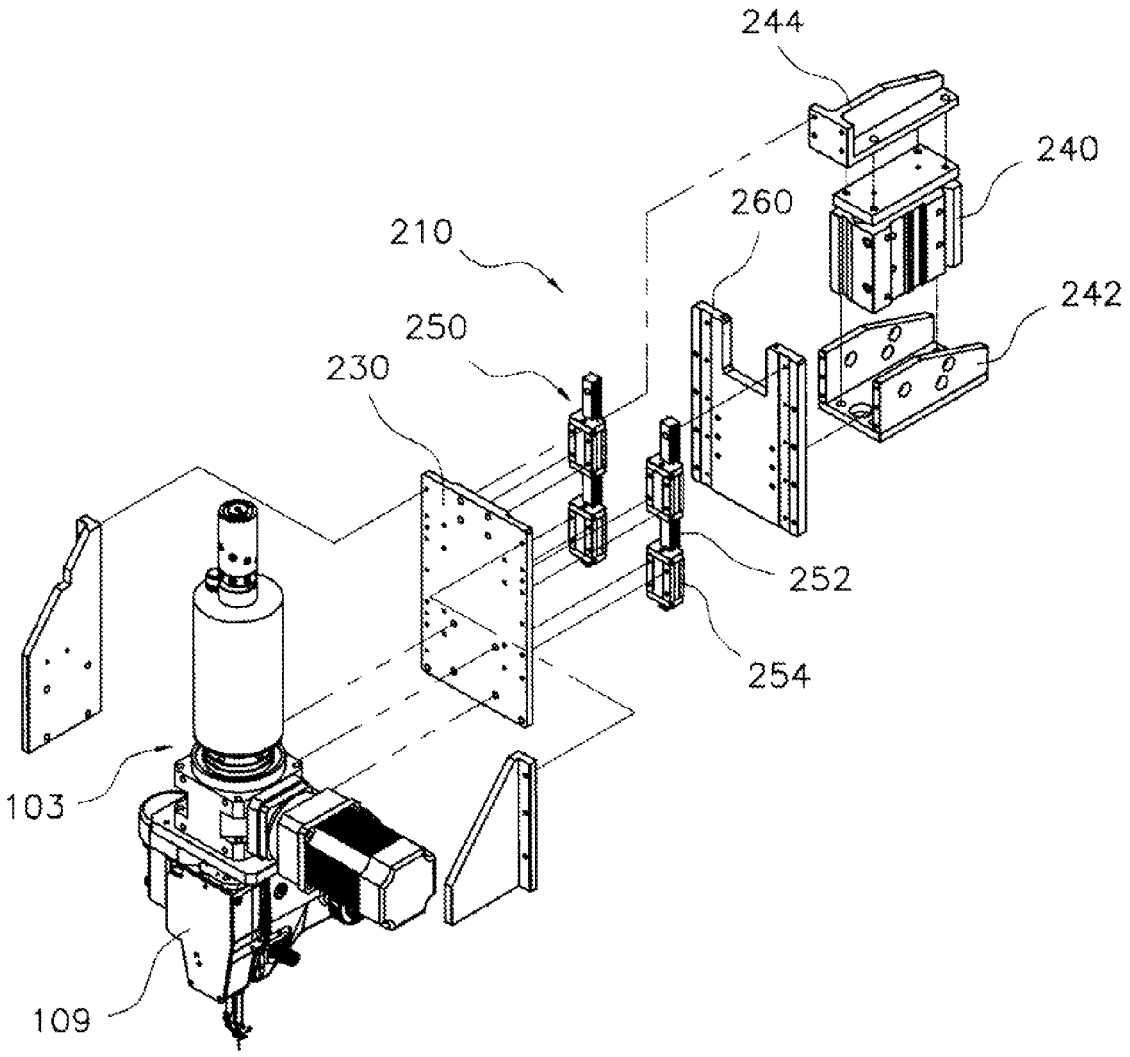
FIG. 6 is an exploded perspective view illustrating a head-unit-lift means according to the present invention.

As shown in FIG. 6, the head-unit-lift means 210 includes a lift actuator 240 and a lift plate 230. The lift actuator 240 is installed in a main body of the sewing machine on an actuator support bracket 242 and provides a drive force used to move the sewing head 109 upwards or downwards. The sewing head 109 is coupled to a central portion of a front surface of the lift plate 230. A head unit connection bracket 244 is connected to an upper end of a rear surface of the lift plate 230. The head unit connection bracket 244 is connected to a drive part of the lift actuator 240.

Furthermore, opposite sides of the rear surface of the lift plate 230 are fastened to a guide means 250, including guide rails 252 and guide couplers 254, so that the lift plate 230 can smoothly and reliably move upwards or downwards.

The guide means 250 is provided on opposite sides of a front surface of a support plate 260 which is installed in the main body of the sewing machine. The actuator support bracket 242, by which the lift actuator 240 is installed in the main body of the sewing machine, is fastened to a central portion of a rear surface of the support plate 260.

The head-unit-lift means 210 has the following operational structure. When the drive part of the lift actuator 240 is operated, the head unit connection bracket 244 which is connected to the drive part of the lift actuator 240 is operated. Thereby, the lift plate 230 which is connected to the front end of the head unit connection bracket 244 is operated along the guide means 250. As a result, the sewing head 109 which is mounted to the front surface of the lift plate 230 is moved upwards or downwards.

The head unit 100 includes the sewing head 109, a lower shaft drive motor (not shown) and a head-unit-rotating means 103. The sewing head 109 is provided with the sewing needle which reciprocates vertically. The upper shaft drive motor operates the sewing needle. The head-unit-rotating means 103 rotates the sewing head 109.

As shown in FIG. 4, the head-unit-rotating means 103 includes a rotating motor 101 which is used as a power source, and a head side power transmission unit which is connected to a drive shaft of the rotating motor 101 and transmits drive force of the rotating motor 101 to a driven shaft that rotates the sewing head 109.

Further, the head-unit-rotating means 103 includes the driven shaft (not shown) which is rotated by the drive force of the rotating motor 101 that is transmitted by the head side power transmission unit, and the sewing head 109 which is provided on the driven shaft and is rotated around the driven shaft.

In an embodiment of the present invention, a rotating drive gear unit 102 is proposed as the head side power transmission unit. The rotating drive gear unit 102 reduces the rpm of the rotating motor 101 and then rotates the sewing head 109 at the rpm. A bevel gear unit is used as the rotating drive gear unit 102.

The bevel gear unit which is used as the rotating drive gear unit 102 of the present invention is configured such that the drive shaft makes a right angle with the driven shaft. The bevel gear unit reduces the rpm of the drive shaft and then rotates the driven shaft at the reduced rpm.

In the present invention, not only the rotating drive gear unit described above but also a different kind of power transmission unit, for example, a belt unit, such as a timing belt, etc., may be used as the head side power transmission unit.

Figure 7A:
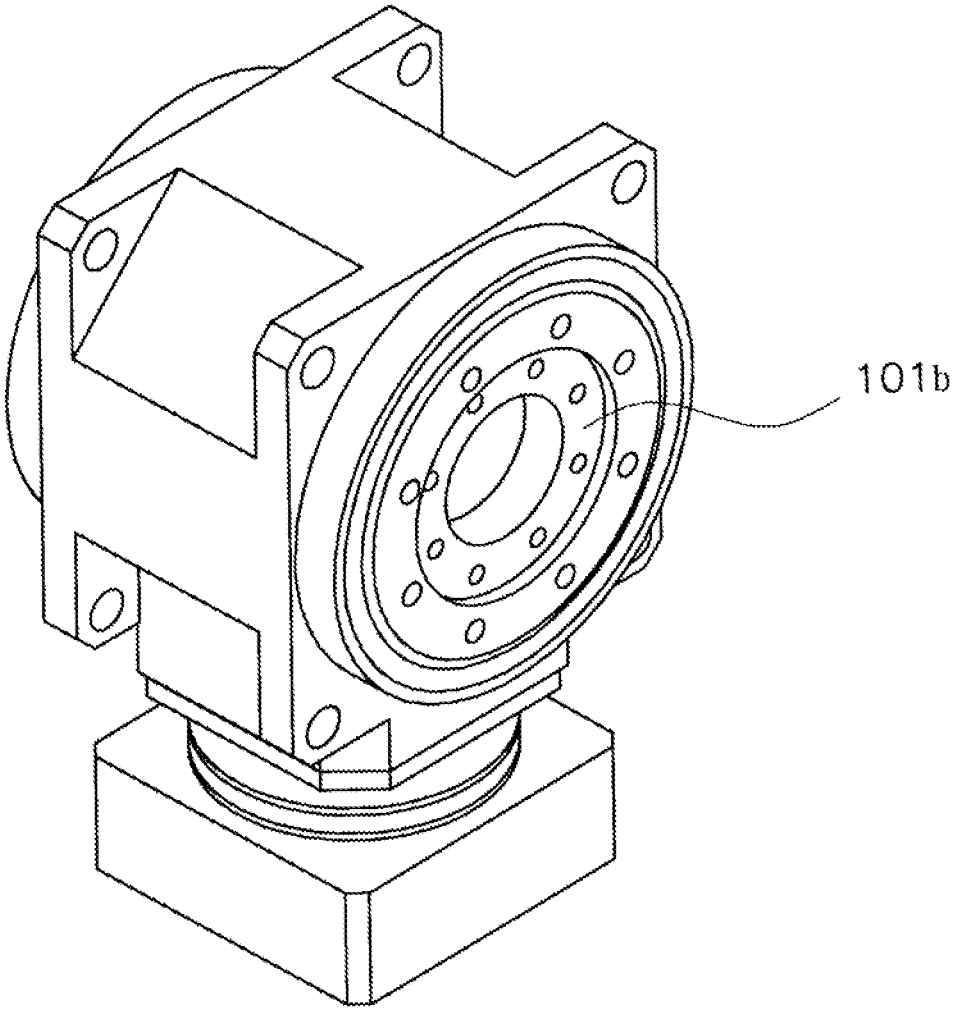
FIGS. 7A and 7B are views showing an embodiment of a rotating drive gear unit according to the present invention.
Figure 7B:
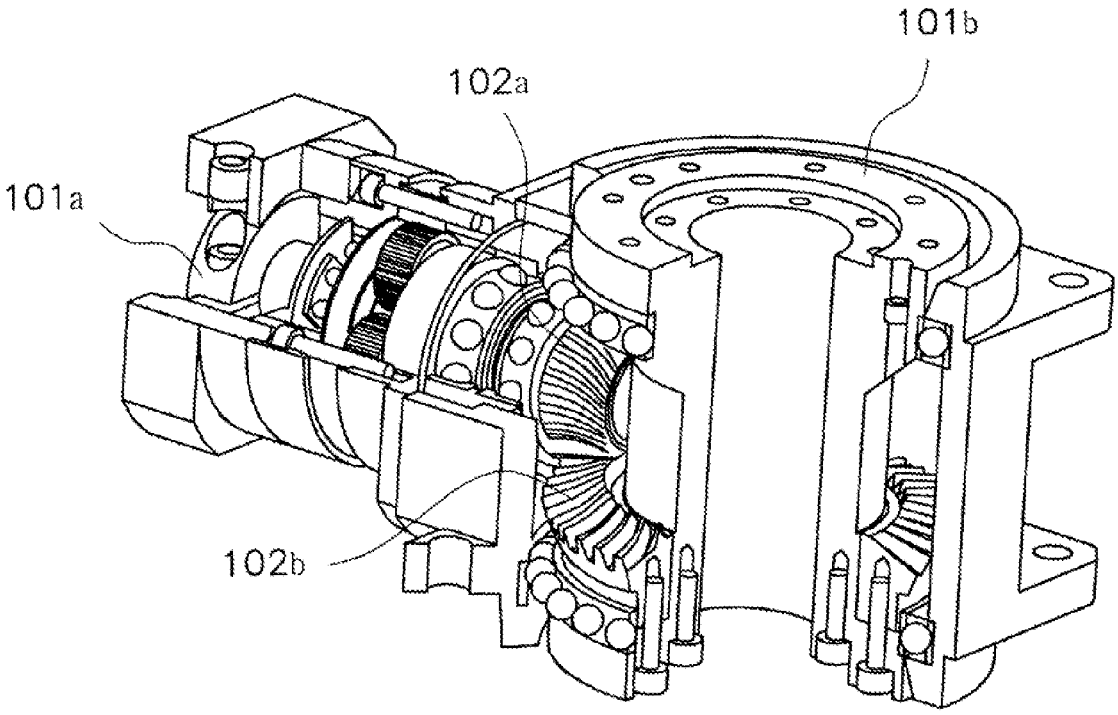

FIGS. 7A and 7B are views showing an embodiment of the rotating drive gear unit of the present invention. In the embodiment of the present invention, the drive shaft 101*a* of the rotating motor 101 which functions as an input shaft is at a right angle to the driven shaft 101*b* which functions as an output shaft. As shown in FIG. 7B, a bevel gear 102*a* which is provided on the drive shaft 101*a* engages with a bevel gear 102*b* which is provided on the driven shaft 101*b*. The bevel gears 102*a* and 102*b* are configured such that the output rpm is markedly reduced.

In an embodiment of the present invention, a rotating drive gear unit is used, which has not only a back driving function which makes it possible to rotate the input shaft (drive shaft) by rotating the output shaft (driven shaft) but also a reduction function which reduces the rpm of the input shaft and transmits the drive force to the output shaft at the reduced rpm. Due to such functions of the rotating drive gear unit, concentricity and a seaming operation of the sewing head 109 and a sewing bed 309 can be facilitated.

Meanwhile, the bed unit 300 includes the sewing bed 309, a lower shaft drive motor which operates a shuttle that is installed in a lower portion of the sewing bed 309, and a bed-unit-rotating means 303 which rotates the sewing bed 309.

As shown in FIG. 5, the bed-unit-rotating means 303 includes a rotating motor 301 which is used as a power source, and a bed side power transmission unit which is connected to a drive shaft of the rotating motor 301 and transmits the drive force of the rotating motor 301 to a driven shaft that rotates the sewing bed 309.

Further, the bed-unit-rotating means 303 includes the driven shaft (not shown) which is rotated by the drive force of the rotating motor 301 that is transmitted by the bed side power transmission unit, and the sewing bed 309 which is provided on the driven shaft and is rotated around the driven shaft.

In an embodiment of the present invention, a rotating drive gear unit 302 is proposed as the bed side power transmission unit. The rotating drive gear unit 302 reduces the rpm of the rotating motor 301 and then rotates the sewing bed 309 at the reduced rpm. A bevel gear unit is used as the rotating drive gear unit 302.

The bed side power transmission unit comprises the bevel gear unit which is configured such that the drive shaft is angled to the driven shaft at the right angle. The bed side power transmission unit has the same construction as that of the head side power transmission unit of the head-unit-rotating means, therefore its further explanation will be omitted.

In the present invention, not only the rotating drive gear unit described above but also a different kind of power transmission unit, for example, a belt unit, such as a timing belt, etc., may be used as the bed side power transmission unit.

In the drawings, the reference numerals 110 and 310 denote slip rings which are used to supply current to the corresponding rotating motors.

Furthermore, a lower shaft drive motor is provided to operate a lower shaft which is installed under the sewing bed 309. The lower shaft drive motor is synchronized with the upper shaft drive motor (not shown) of the head unit 100 so that they are operated at the same time. The rotating motor 301 of the bed unit 300 is synchronized in momentum with the rotating motor 101 of the head unit 100 so that they are operated together.

Meanwhile, the sewing machine of the present invention is configured such that the sewing frame 50 can be moved in the direction of the X-axis or the Y-axis. Thus, even though the head unit 100 is fixed at the same position, the range within which the object can be processed can be increased.

The X-axial transport means is oriented in the X-axis direction of the table 10. The Y-axial transport means is oriented in the Y-axis direction of the table 10.

Figure 8:
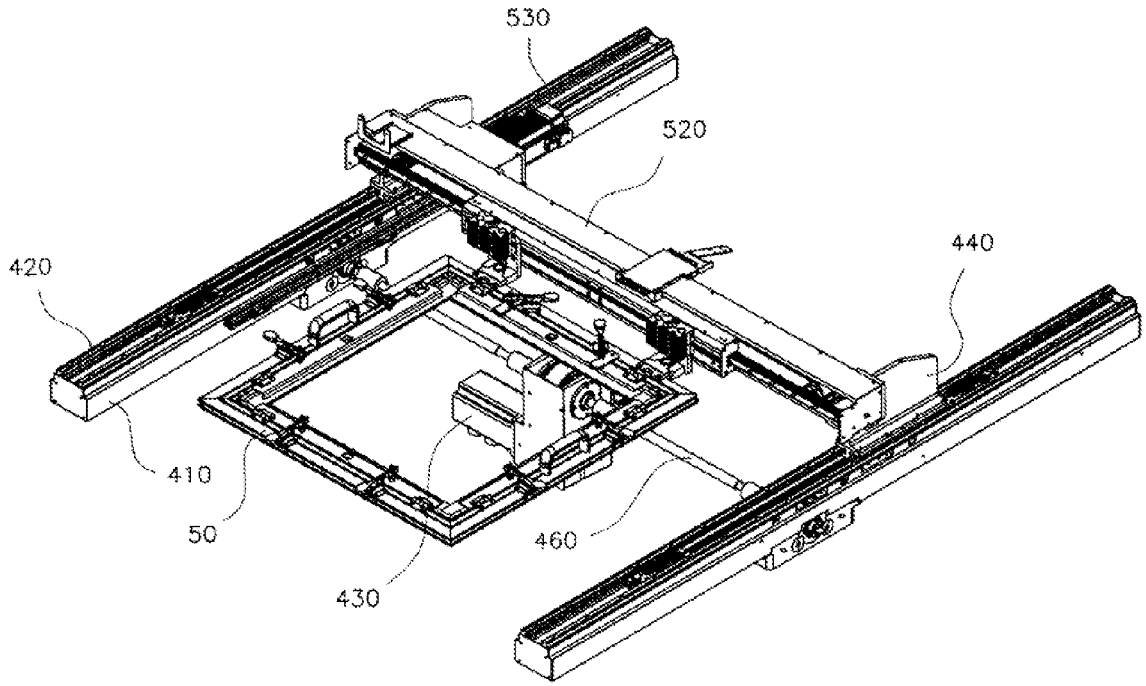
FIG. 8 is a perspective view showing an X-Y transport structure according to the first embodiment of the present invention.
Figure 9A:
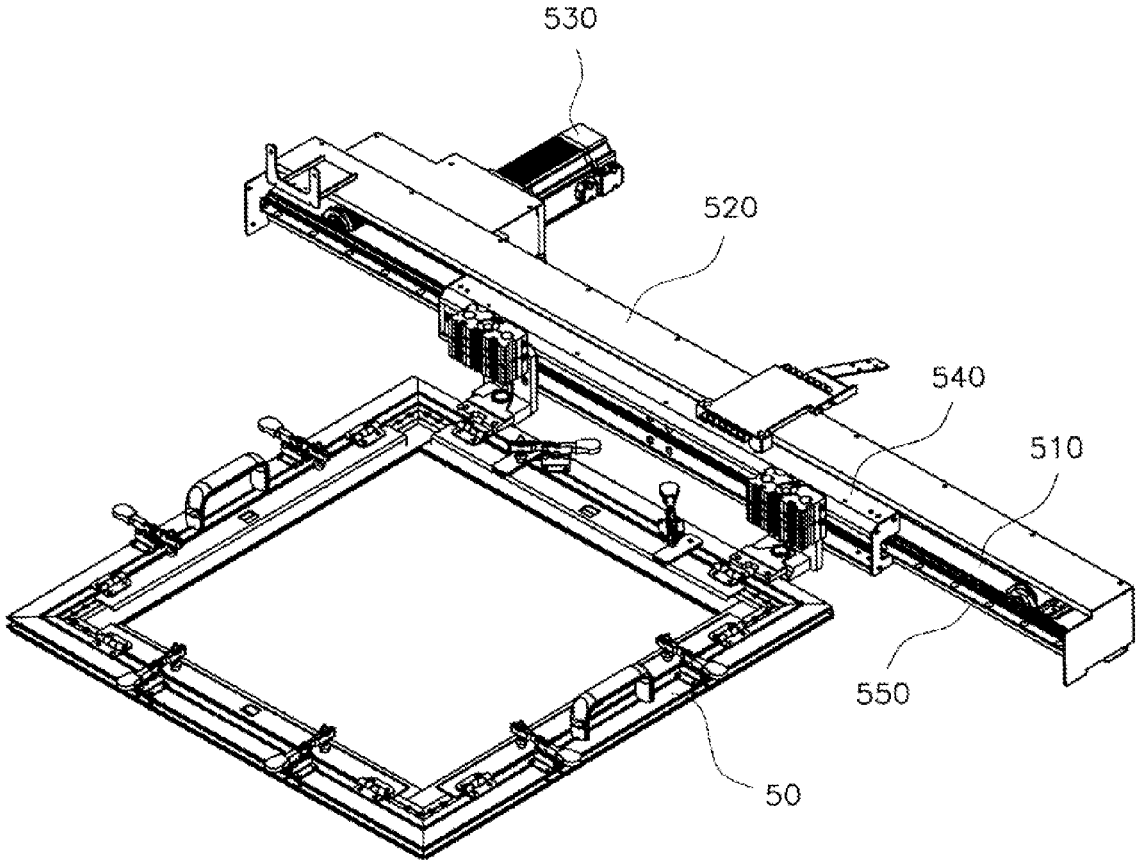
FIGS. 9A and 9B are perspective views separately showing an X-axis transport structure and a Y-axis transport structure of FIG. 8.
Figure 9B:
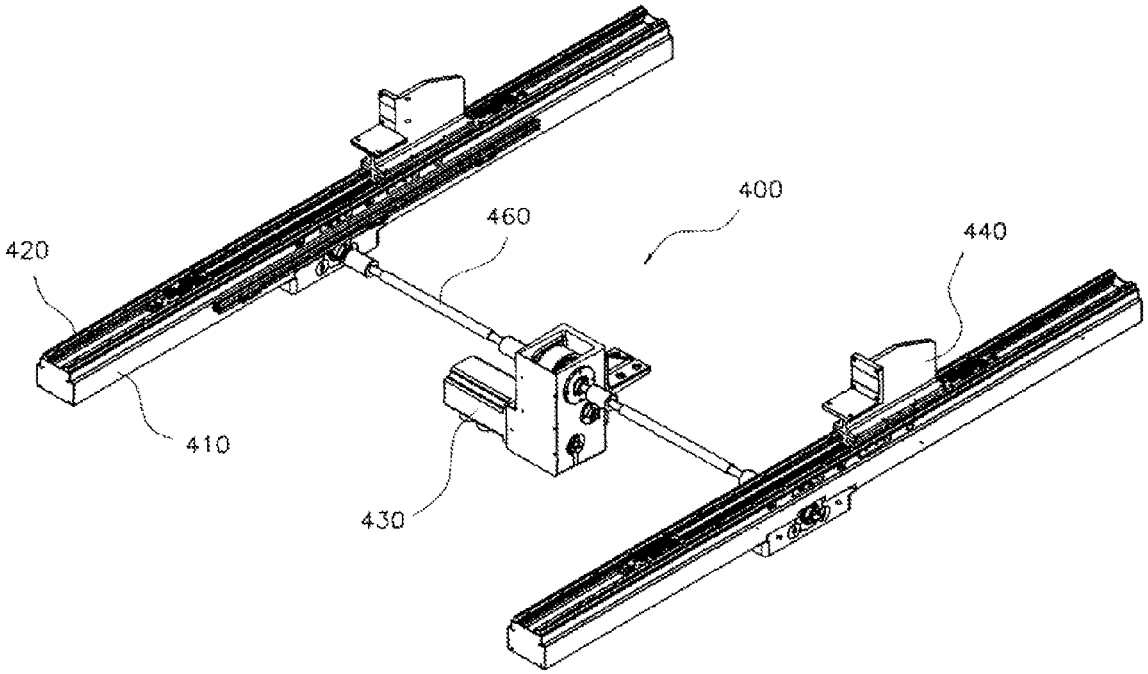

Well-known structures may be used as the X-axial transport means and the Y-axial transport means. In an embodiment of the present invention, as shown in FIGS. 8 through 9B, each of the X-axial transport means and Y-axial transport means includes a rotating motor.

In an embodiment of the present invention, the X-axial transport means includes an X-axial transport motor 530, a power transmission means, a transport bracket 540 and a guide rail 550. The X-axial transport motor 530 provides drive force. The power transmission means transmits the drive force of the X-axial transport motor 530. The sewing frame 50 is mounted to a front surface of the transport bracket 540. The transport bracket 540 is connected to the power transmission means so that as the power transmission means is operated, the transport bracket 540 reciprocates in the horizontal direction. The transport bracket 540 is movably coupled to the guide rail 550 so that the transport bracket 540 can horizontally move along an X-axial frame 520.

A servomotor, step motor or the like can be used as the X-axial transport motor 530. The power transmission means may comprise a pulley which is rotated by the X-axial transport motor 530, and a timing belt 510 which is coupled to the pulley and is moved in the X-axis direction.

In this case, the transport bracket 540 is coupled to the timing belt 510 and is moved in the X-axis direction.

Meanwhile, as shown in FIG. 9B, the Y-axial transport means includes a Y-axial frame 410, a guide rail unit 420, a support unit 440, a Y-axial transport motor 430 and a transport shaft 460. The Y-axial frame 410 extends a predetermined length in the Y-axis direction. The guide rail unit 420 is provided on the Y-axial frame 410. The support unit 440 transports a sewing frame 50 along the guide rail unit 420 in the Y-axis direction. The Y-axial transport motor 430 provides a drive force that moves the support unit 440 along the guide rail unit 420 in the Y-axis direction. The transport shaft 460 transmits the drive force of the Y-axial transport motor 430 to the support unit 440.

The X-axial frame 520 is fastened to the support unit 440. Thus, the X-axial frame 520 and the sewing frame 50 can be moved in the Y-axis direction by Y-axial movement of the support unit 440.

The guide rail unit 420 includes a guide rail (not shown), a transport member (not shown) and a drive force transmission unit (not shown). The guide rail is installed on the Y-axial frame 410 and guides the transport member (not shown), which is provided in the guide rail, so that the transport member can move forwards and rearwards (in the Y-axis direction). The transport member is provided in the guide rail (not shown) and has on a lower end thereof gear teeth which engage with a drive belt of the drive force transmission unit (not shown). An upper end of the transport member is coupled to the support unit 440. The drive force transmission unit includes a power unit comprising a plurality of pulleys which operate the drive belt that engages with the gear teeth of the transport member (not shown). Thus, the drive force transmission unit functions to transmit the drive force of the Y-axial transport motor 430 to the transport member.

A small-diameter drive pulley (not shown) is fitted over the drive shaft of the Y-axial transport motor 430 and is connected to a large-diameter driven pulley (not shown) by a timing belt. The driven pulley is fitted over a transport shaft 460 which transmits the drive force of the Y-axial transport motor 430 to the drive force transmission unit of the guide rail unit 420.

The drive force transmission process of the Y-axial transport means 400 is as follows. When the drive pulley connected to the drive shaft of the Y-axial transport motor 430 rotates, the large-diameter driven pulley which is connected to the drive pulley by the timing belt is synchronized with and rotated along with the drive pulley. Then, the transport shaft 460 which is fitted through the driven pulley is rotated along with the large-diameter driven pulley.

The transport shaft 460 which is connected to the drive force transmission unit (not shown) of the guide rail unit 420 operates the power unit provided in the drive force transmission unit, thus operating the drive belt. The transport member which engages with the drive belt is operated by the operation of the drive belt. Thereby, the support unit 440 which is mounted to the transport member is operated.

Due to the X-Y transport structure having the above-mentioned construction, the sewing frame 50 can be moved on the X-axial frame 520 in the X-axis direction by the X-axial transport means and moved in the Y-axis direction by the Y-axial transport means. Thereby, the sewing machine can process an object having a large area to be sewn.

Figure 10A:
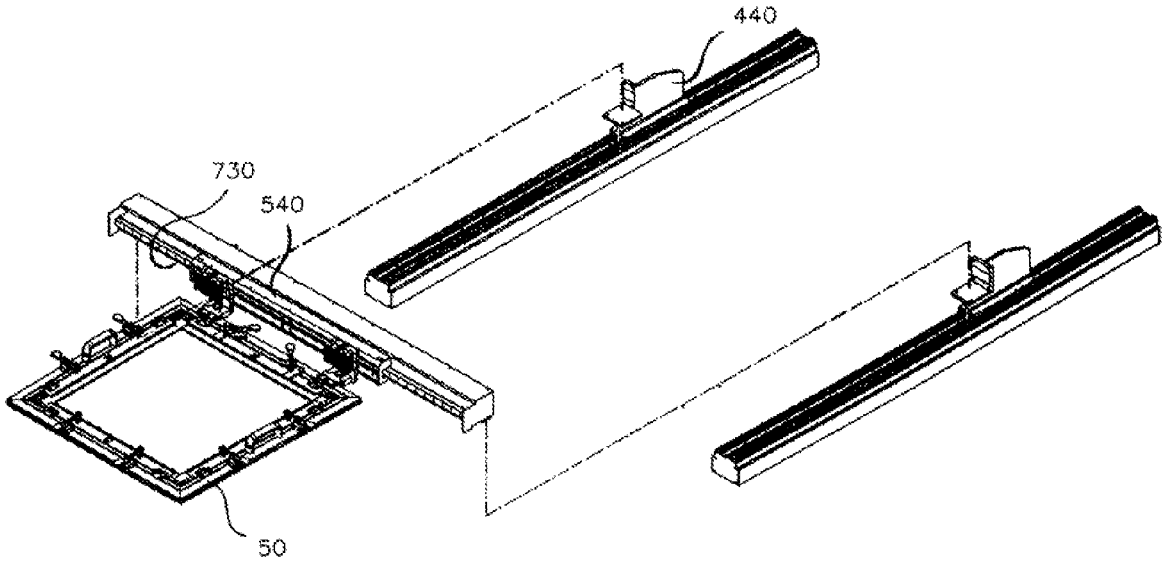
FIGS. 10A and 10B is a perspective view showing another embodiment of an X-Y transport structure according to the present invention, showing the case where a linear motor is used as a drive source.
Figure 10B:
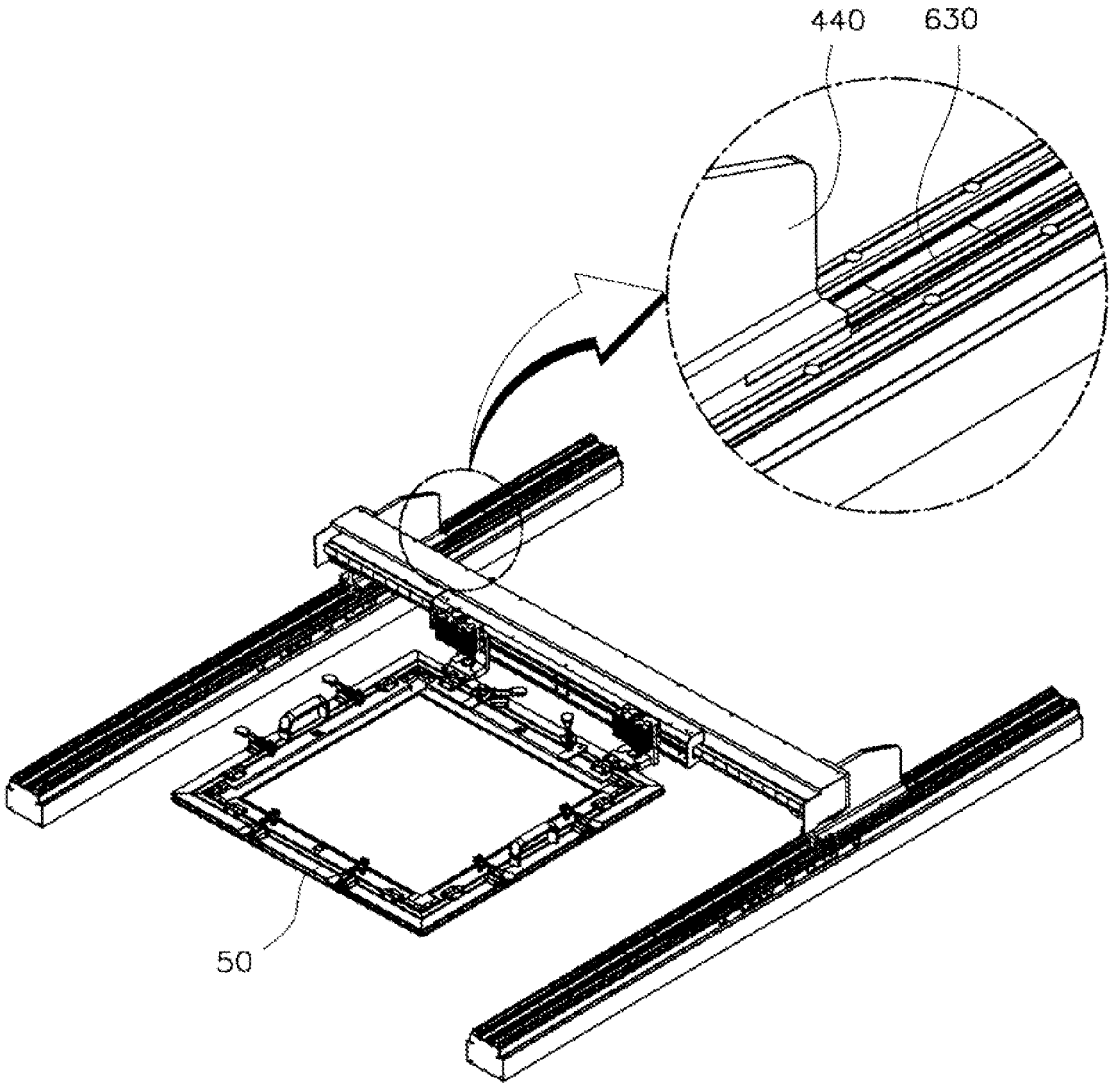

FIGS. 10A and 10B illustrate an embodiment in which a linear motor is used as a drive source of each of the X-axial transport means and the Y-axial transport means. An X-axial linear motor 730 is used to transport the transport bracket 540, to which the sewing frame 50 is mounted, in the X-axis direction. A Y-axial linear motor 630 is used to transport the transport bracket 540 in the Y-axis direction.

As well as the rotating motor or the linear motor which was stated in the description of the embodiment of the present invention, a ball screw structure can be used as a drive source of each of the X-axial transport means and the Y-axial transport means. In addition, any other power generating means can be used as the drive source. In the present invention, the drive source is not limited to any special structure.

The operation of the sewing machine of the present invention having the above-mentioned construction will be explained below.

To start sewing, a sewing start switch (not shown) is turned on. Then, the head unit 100 moves downwards, and the upper shaft drive motor of the head unit is operated. The lower shaft drive motor of the bed unit 300 which is synchronized with the upper shaft drive motor of the head unit 100 is operated along with the upper shaft drive motor.

To sew the object in a circular, curved or slant line, when the head unit rotating motor 101 is operated, the sewing head 109 is rotated by drive force which is transmitted from the head unit rotating motor 101 by the head side power transmission unit.

Here, because the bed unit rotating motor 301 is synchronized in momentum with the head unit rotating, motor 101, the sewing bed 309 is also rotated.

As such, the sewing head 109 and the sewing bed 309 rotate together while sewing the object. Therefore, the quality of sewing relative to the variation in the rotation angle can be made better.

That is, because the head unit 100 and the bed unit 300 are completely rotated by the head unit rotating motor 101 and the bed unit rotating motor 301 before the upper shaft drive motor and the lower shaft drive motor are operated, the orientation of a sewn thread can be maintained constant. Hence, even when sewing an object, such as an airbag, a bag, a shoe, etc., the perfect stitch can be realized over the entirety of the object.

A method of controlling the operation of the sewing machine of the present invention will be described below.

After the sewing needle of the head unit 100 has been disposed above a needle plate, the X-axial transport motor 530, the Y-axial transport motor 430, the head unit rotating motor 101 and the bed unit rotating motor 301 are operated depending on data input to the control unit.

As such, to ensure the safety in use, only when the sewing needle of the head unit 100 is disposed above the needle plate can the X-axial transport motor 530, the Y-axial transport motor 430, the head unit rotating motor 101 and the bed unit rotating motor 301 be operated. For this, a needle position sensing means for detecting whether the sewing needle is disposed above the needle plate is provided. A well-known sensing means can be used as the needle position, sensing means.

Thereafter, the upper shaft drive motor and the lower shaft drive motor are operated to move the sewing needle downwards, thus forming a stitch. When the sewing needle moves upwards and is thus disposed above the needle plate again, the X-axial transport motor 530, the Y-axial transport motor 430, the head unit rotating motor 101 and the bed unit rotating motor 301 are operated to repeat the above process.

Here, the rpms of the X-axial transport motor, the Y-axial transport motor, the head unit rotating motor 101 and the bed unit rotating motor 301 can be controlled in response to the rpm of the upper shaft drive motor which moves the sewing needle upwards and downwards. Typically, the rpms of these are controlled in proportion to, especially in linear proportion to, the rpm of the upper shaft drive motor. As stated above, the lower shaft drive motor is synchronized with the upper shaft drive motor and operated along with it, therefore a further explanation thereof will be omitted.

Meanwhile, while stitching at high speed, if the head unit 100 and the bed unit 300 suddenly rotate, the stitching operation may not be smooth, or stress may be applied to the elements of the sewing machine. Therefore, the sewing machine is preferably configured such that the rpm of the upper shaft drive motor is reduced to a predetermined range before the head unit 100 and the bed unit 300 rotate, for example, before 5 to 10 stitches prior to when they begin to rotate. As necessary, the upper shaft drive motor may temporarily stop.

Furthermore, the rpm of the upper shaft drive motor may be controlled in response to the angle at which the head unit 100 and the bed unit 300 rotate. As the rpm of the upper shaft drive motor increases, the time for which the rotating motors 101 and 301 can move to a predetermined angle is reduced. Thus, preferably, the angle at which the head unit 100 and the bed unit 300 rotate is inversely proportional to the rpm of the upper shaft drive motor. For instance, if the angle at which the head unit 100 and the bed unit 300 rotate is 30° or more, the rpm of the upper shaft drive motor is lowered to a range from 0 rpm to 100 rpm before the rotating motors 101 and 301 are operated. If the rotating motor 101 and 301 are not in operation or rotate to a predetermined angle or less, the rpm of the upper shaft drive motor automatically returns to the normal level.

Figure 11:
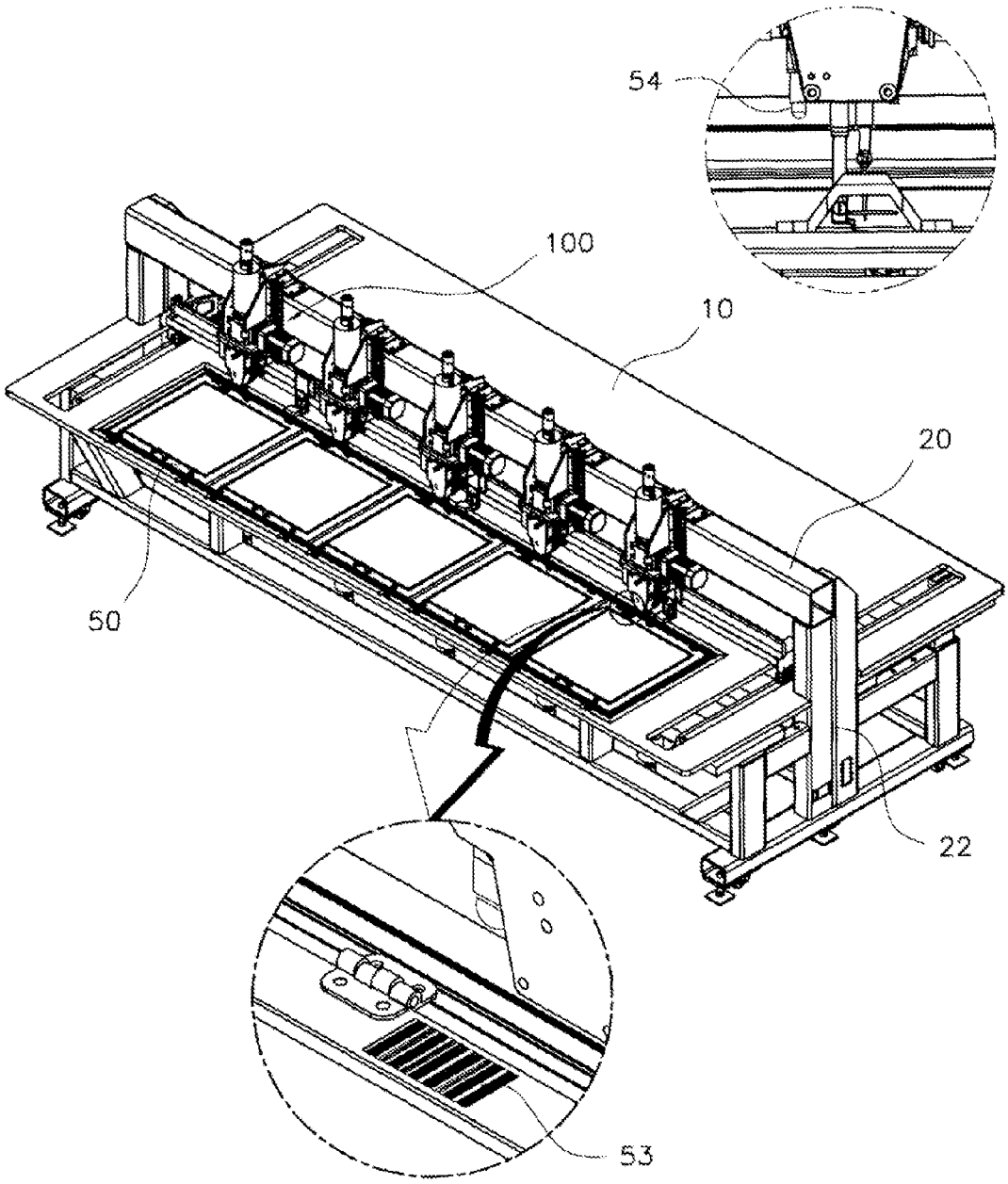
FIG. 11 illustrates a second embodiment of the present invention, showing a perspective view of a sewing machine having multi-sewing heads.
Figure 12:
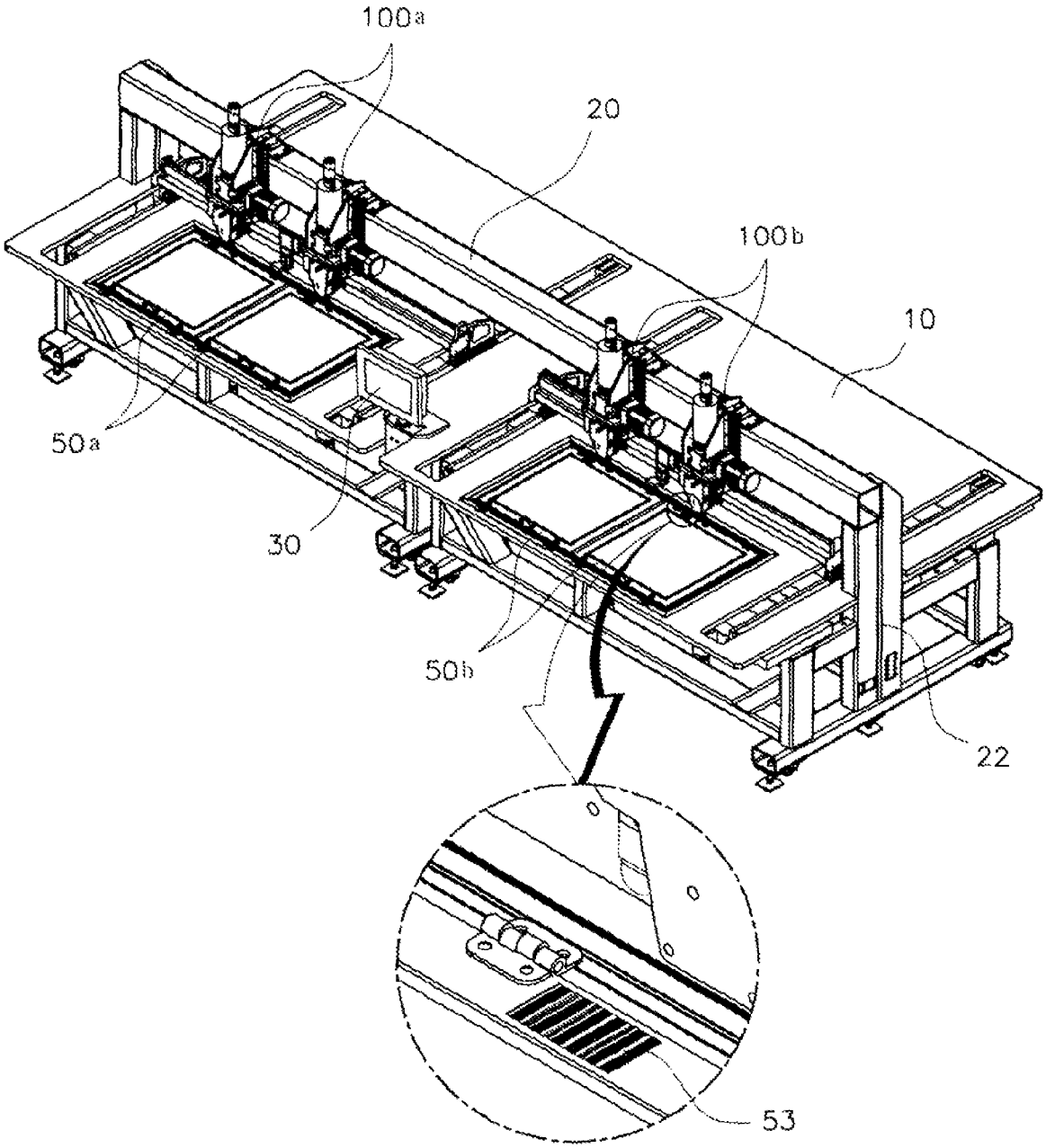
FIG. 12 illustrates a third embodiment of the present invention, showing a perspective view of a sewing machine having multi-sewing heads that are independently operated.
Figure 13:
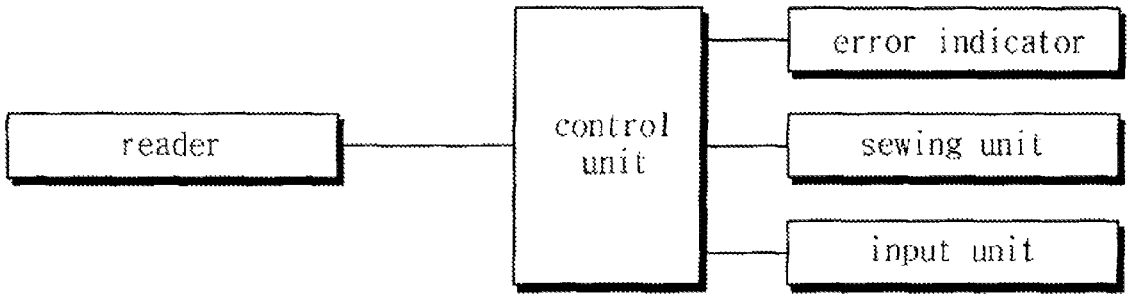
FIG. 13 is a block diagram showing the construction of a barcode data processing device according to the second or third embodiment of the present invention.
Figure 14:
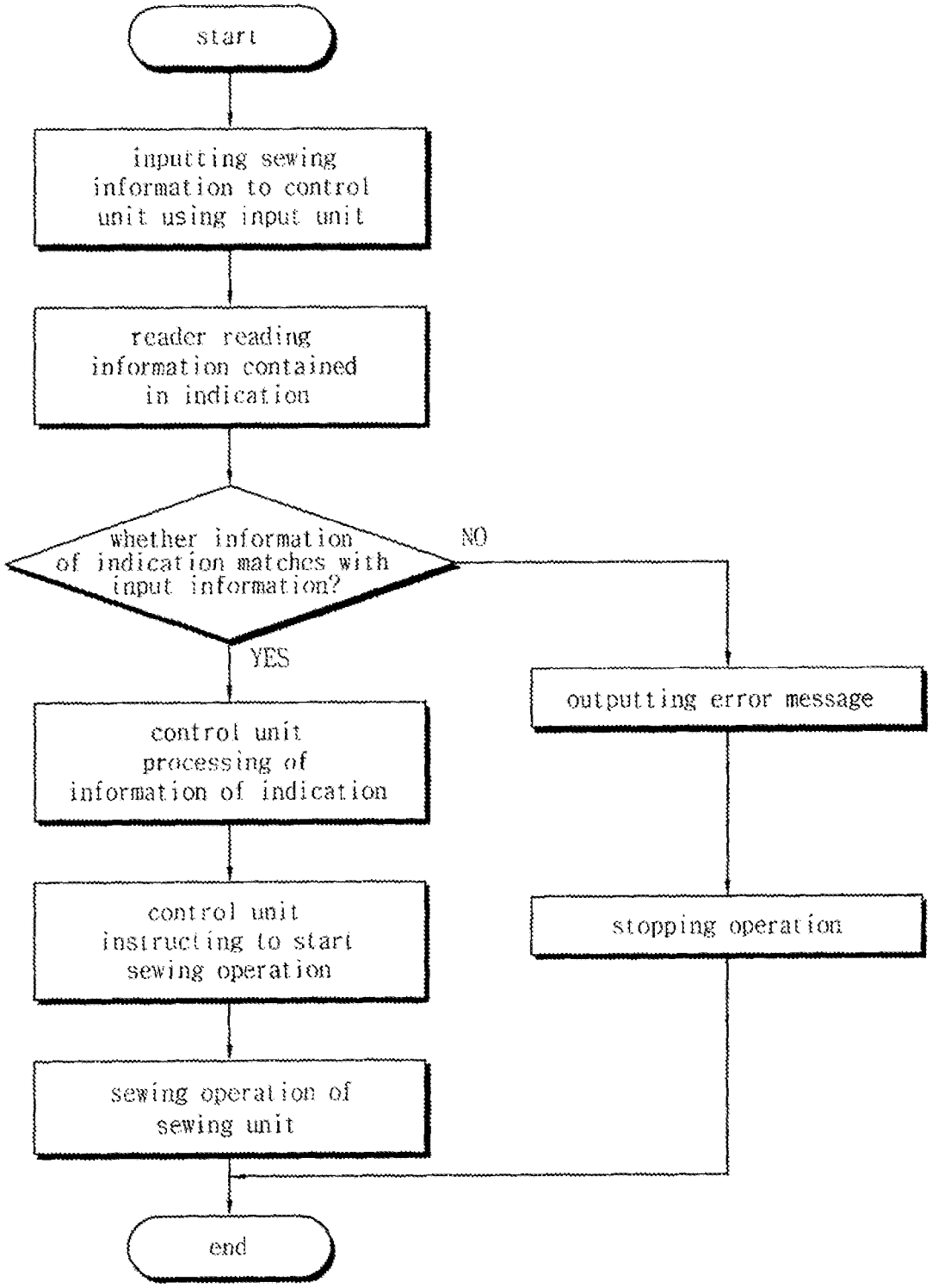
FIG. 14 is a flowchart of a barcode data processing method of the barcode data processing device of FIG. 13.

Meanwhile, FIG. 11 illustrates a second embodiment of the present invention, showing a perspective view of a sewing machine having multi-sewing heads. FIG. 12 illustrates a third embodiment of the present invention, showing a perspective view of a sewing machine having multi-sewing heads that are independently operated.

In the second embodiment of the present invention, the head unit 100 comprises a plurality of head units 100 which are arranged in a row on the upper beam 20. The bed unit also comprises a plurality of bed units which are arranged to correspond to the respective head units 100. A plurality of objects are held by a single sewing frame 50 on the table 10. Thus, the sewing machine of the second embodiment can sew the objects at the same time.

The sewing frame 50 can be moved in the X-Y axis directions by the X-Y transport structure.

The method of placing the objects on the sewing frame 50 is as follows. Subsidiary sewing frames may be individually removably provided at positions corresponding to the respective head units 100. Alternatively, as shown in the drawings, object support members which are individually partitioned from each other may be provided on the single sewing frame 50, so that the objects are respectively held on the object support members.

In other words, the sewing frame 50 may be configured such that the subsidiary sewing frames are individually removably provided on the single large sewing frame 50. Alternatively, the object support members may be provided on the sewing frame 50 in such a way that the sewing frame 50 is partitioned only into several work sections by the object support members, so that only the objects can be removable from the sewing frame 50. However, the present invention is not limited only to these structures.

Meanwhile, each of the sewing heads which are arranged in a row on the upper beam 20 is rotatably configured. Here, the sewing heads are operated in the same direction at the same time by sewing data (pattern data) which is input by a worker so that the objects which are placed on the table 10 can be sewn at the same time in the same shape.

Because such a multi-head structure can process a plurality of objects at the same time, the productivity of the sewing machine can be markedly enhanced.

Moreover, different colors of threads (yarns) may be used to sew the objects which are placed on the sewing frame 50. In this case, although the objects are sewn in the same shape, they can be sewn in different colors. Therefore, the optimum colors of the threads (yarns) suitable for the sewing design can be easily selectively used.

Meanwhile, as shown in FIG. 12, in the third embodiment of the present invention, a plurality of groups of head units 100*a* and 100*b* which can be independently operated are provided on the upper beam 20. Furthermore, a plurality of groups of bed units which correspond to the respective groups of head units 100*a* and 100*b* are separately arranged. A plurality of sewing frames 50*a* and 50*b* are provided on the table 10 so that the groups of head units 100*a* and 100*b* can independently conduct the sewing operation on individual areas.

In detail, a plurality of groups of sewing, heads are separately provided on the upper beam 20 so as to be rotatable. Each of the sewing frames 50*a* and 50*b* which are provided on the table 10 and allow objects to be placed thereon can move in X-Y axis directions by an X-Y transport structure. Here, the number of X-Y transport structures is the same as that of the groups of sewing frames.

The method of placing the objects on the sewing frames 50 is as follows. Subsidiary sewing frames may be individually removably provided at positions corresponding to the respective head units 100. Alternatively, as shown in the drawings, object support members which are individually partitioned from each other may be provided on the sewing frames 50*a* and 50*b*, so that the objects are respectively held on the object support members.

In other words, the sewing frames 50*a* and 50*b* may be configured such that the subsidiary sewing frames are individually removably provided on each sewing frame 50*a*, 50*b*. Alternatively, the object support members may be provided on each large sewing frame 50*a*, 50*b* in such a way that each sewing frame 50*a*, 50*b* is partitioned only into several work sections by the object support members, so that only the objects can be removable from the sewing frame 50*a*, 50*b*. However, the present invention is not limited to only these structures.

Referring to FIGS. 11 and 12, a plurality of work sections are arranged in a row in the X-axis direction.

In the present invention, the object support members, each of which individually supports a single object that is a single work unit, are provided on the sewing frame 50. Thus, the sewing frame 50 has a plurality of work sections.

An indication 53, which containing information about a sewing pattern, sewing information and a working method, is formed on a predetermined portion of the sewing frame 50. A reading means 54 which scans the indication 53 is provided on the head unit 100.

The reading means 54 reads the information contained in the indication 53 and sends it to the control unit. The nub of the information contained in the indication 53 includes which pattern to sew or which way to sew.

A great variety of information, as well as the sewing pattern and sewing work information, can be contained in the indication 53.

Examples of the great variety of information may include how much work is left to do, by how much to reduce the stitching speed when the objects are tough or thick, etc.

As such, because the indication 53 and the reading means 54 are used, each object can be sewn in a different pattern P that is desired by the worker.

This structure will contribute greatly to the improvement of productivity in a recent consumer market which is moving towards small quantity batch production.

Furthermore, using the indication 53 and reading means 54 is advantageous in that the working errors can be detected in advance as follows.

Before the sewing operation begins, the worker inputs, using an input means or wire/wireless communication means, information about a sewing pattern and the sewing work to the control unit of the sewing machine. The reading means 54 reads information contained in the indication 53, and the sewing unit begins the sewing operation when the information about the sewing pattern and the sewing work that was input to the control unit before the sewing operation matches with the information that the reading means 54 read. If the two kinds of information differ from each other, an error indicator generates an error signal to let the worker recognize this.

For example, after the worker inputs information about the sewing pattern and the sewing work to the control unit of the sewing machine using the input means or wire/wireless communication means and stores it in the control unit before the sewing operation begins, if the sewing work information that has been stored in the control unit of the sewing machine differs from the current information that is contained in the indication 53 of the sewing frame 50, an error signal is generated to let the worker know the difference, and the sewing operation is stopped.

Such an operation of the sewing machine of the present invention can prevent a problem in which expensive fabric may be destroyed by carrying out work that is incorrect and not desired by the worker.

In the present invention, one selected from among a variety of styles, such as numerals, colors, a punch card, a barcode and an RFID card, etc., can be selectively used as the indication 53.

In an embodiment of the present invention, a barcode which is inexpensive but is able to contain a lot of information is used. In this case, the reading means 54 comprises a barcode reader.

Furthermore, in another embodiment of the present invention, a sewing frame position sensing means (not shown) may be further provided, which determines whether the subsidiary sewing frames are disposed on the sewing frame at the correct positions.

A proximity sensor, a resistance sensor or the like can be selectively used as the sewing frame position sensing means.

Meanwhile, each of the sewing heads which are provided on the upper beam 20 in groups is rotatably configured. Here, the sewing heads can be independently operated by sewing data (pattern data) which is input by a worker so that the objects which are placed on the table can be sewn in different shapes.

Because such an independent-operation structure can process different kinds of objects in different shapes, the productivity of the sewing machine with respect to many different kinds of products can be markedly enhanced.

Furthermore, the present invention can produce different kinds of designs of products at the same time, thus further enhancing the productivity.

As described above, in a sewing machine according to the present invention, a head unit and a bed unit can rotate while sewing. Thus, the orientation of a sewn thread can be maintained constant. Therefore, even when sewing an object, such as an airbag, a bag, a shoe, etc., a perfect stitch can be realized over the entirety of the object.

Furthermore, unlike the conventional sewing machine in which an arm part is connected to a bed unit by a connection unit, the head unit is provided on a bridge supported by a support post, so that the sewing machine can be designed in an arch shape without a vertical connection structure being required to connect the head unit to the bed unit. Hence, a sewing work area with respect to a Y-axis direction of the sewing machine can be markedly increased.

Further, in the case of the structure in which the head unit is provided on the bridge, because vibrations which are generated when the head unit and the bed unit rotate are markedly reduced, the sewing operation can be more rapidly carried out.

Moreover, placing an object on the head unit or removing it therefrom is facilitated because the head unit is movable vertically. Unlike the conventional technique which can sew only a thin object, the sewing machine of the present invention can sew objects of different thicknesses including comparatively thick objects as well as thin objects.

Furthermore, in the conventional sewing machine, the upper and lower shafts are connected to a single motor by timing belts or the like. Thus, an excessive load is applied to the motor. However, in the present invention, an upper shaft drive motor and a lower shaft drive motor are separately provided and operated, thus avoiding the conventional problem of the excessive load, and making it possible to increase the speed of the sewing operation.

Moreover, a plurality of objects to be sewn can be processed at the same time. Thus, the productivity of the sewing machine can be markedly enhanced.

In addition, the sewing machine of the present invention is operated such that a reading means reads information about an object to be sewn and the object is sewn in accordance with the read information, thus preventing working errors in advance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sewing machine comprising:

a table, on which an object to be sewn is placed;

support posts provided on opposite sides of the table;

an upper beam connecting the support posts to each other, the upper beam being coupled to upper ends of the support posts;

a head unit fastened to the upper beam above the table, the head unit having head-unit-rotating means for rotating a sewing head within a predetermined range; and a bed unit provided to the table, the bed unit having bed-unit-rotating means for rotating a sewing bed within a predetermined range independently to the head unit.

2. The sewing machine as set forth in claim 1, wherein the head-unit rotating means comprises:

a rotating motor used as a power source;

a power transmission unit connected to a drive shaft of a rotating motor, the power transmission unit transmitting a drive force of the rotating motor;

a driven shaft rotated by the drive force of the rotating motor transmitted by the power transmission unit; and a sewing head provided on the driven shaft, the sewing head being rotated around the driven shaft.

3. The sewing machine as set forth in claim 2, wherein the power transmission unit comprises a rotating drive gear reducing an rpm of the rotating motor and transmitting the drive force to the driven shaft at a reduced rpm.

4. The sewing machine as set forth in claim 3, wherein the rotating drive gear comprises a bevel gear configured such that the drive shaft is at a right angle to the driven shaft.

5. The sewing machine as set forth in claim 2, wherein the power transmission unit comprises a timing belt.

6. The sewing machine as set forth in claim 1, wherein the bed-unit-rotating means comprises:

a rotating motor used as a power source;

a power transmission unit connected to a drive shaft of a rotating motor, the power transmission unit transmitting a drive force of the rotating motor;

a driven shaft rotated by the drive force of the rotating motor transmitted by the power transmission unit; and the sewing bed provided on the driven shaft.

7. The sewing machine as set forth in claim 6, wherein the power transmission unit comprises a rotating drive gear reducing an rpm of the rotating motor and transmitting the drive force to the driven shaft at a reduced rpm.

8. The sewing machine as set forth in claim 7, wherein the rotating drive gear comprises a bevel gear configured such that the drive shaft is at a right angle to the driven shaft.

9. The sewing machine as set forth in claim 6, wherein the power transmission unit comprises a timing belt.

10. The sewing machine as set forth in claim 1, wherein a momentum of a rotating motor of the bed-unit-rotating means is synchronized with a rotating motor of the head-unit-rotating means so that the rotating motors are operated together.

11. The sewing machine as set forth in claim 1, further comprising:

a sewing frame holding the object;

X-axial transport means for transporting the sewing frame in an X-axis direction; and Y-axial transport means for transporting the sewing frame in a Y-axis direction.

12. The sewing machine as set forth in claim 11, wherein the X-axial transport means comprises:

an X-axial transport motor providing a drive force;

power transmission means for transmitting the drive force of the X-axial transport motor;

a transport bracket connected to the power transmission means, the transport bracket being reciprocated in a horizontal direction by operation of the power transmission means, with the sewing frame fastened to a front surface of the transport bracket; and a guide rail coupled to the transport bracket so that the transport bracket is able to move horizontally on an X-axial frame.

13. The sewing machine as set forth in claim 11, wherein the Y-axial transport means comprises:

a Y-axial frame extending a predetermined length in the Y-axis direction;

a guide rail unit provided on the Y-axial frame;

a support unit transporting the sewing frame along the guide rail unit in the Y-axis direction;

a Y-axial transport motor providing a drive force to transport the support unit along the guide rail unit in the Y-axis direction; and a transport shaft transmitting the drive force of the Y-axial transport motor to the support unit.

14. The sewing machine as set forth in claim 11, wherein the X-axial transport means comprises:

an X-axial linear motor providing a drive force to transport the sewing frame on an X-axial frame in the X-axis direction; and a transport bracket reciprocated in the X-axis direction by the drive force of the X-axial linear motor, with the sewing frame fastened to a front surface of the transport bracket.

15. The sewing machine as set forth in claim 11, wherein the Y-axial transport means comprises:

a Y-axial frame extending a predetermined length in the Y-axis direction;

a Y-axial linear motor provided on the Y-axial frame, the Y-axial linear motor providing a drive force to transport the sewing frame in the Y-axis direction; and a support unit transporting the sewing frame in the Y-axis direction in response to operation of the Y-axial linear motor.

16. The sewing machine as set forth in claim 1, further comprising:

head-unit-lift means provided between the head unit and the upper beam, the head-unit-lift means moving the sewing head upwards and downwards between a standby position and a work position.

17. The sewing machine as set forth in claim 16, wherein the head-unit-lift means comprises:

a lift actuator installed in a main body of the sewing machine by an actuator support bracket, the lift actuator providing a drive force to move the sewing head upwards or downwards; and a lift plate coupled at a central portion of a front surface thereof to the sewing head, the lift plate being coupled on an upper end of a rear surface thereof to a head unit connection bracket connected to a drive part of the lift actuator, with guide means mounted to opposite sides of the rear surface of the lift plate.

18. The sewing machine as set forth in claim 16, wherein the head-unit-lift means further comprises;

a support plate coupled on opposite sides of a front surface thereof to the guide means, with an actuator support bracket mounted to a central portion of a rear surface of the support plate, the actuator support bracket supporting the lift actuator thereon.

19. The sewing machine as set forth in claim 1, wherein the head unit comprises a plurality of head units arranged in a row on the upper beam, the bed unit comprises a plurality of bed units arranged in such a way as to correspond to the respective head units, and a plurality of objects are held by a single sewing frame on the table so that a plurality of sewing operations are able to be conducted simultaneously.

20. The sewing machine as set forth in claim 19, further comprising:

X-axial transport means for transporting the sewing frame in the X-axis direction; and Y-axial transport means for transporting the sewing frame in the Y-axis direction.

21. The sewing machine as set forth in claim 1, wherein the head unit comprises a plurality of groups of head units provided on the upper beam, the plurality of groups of head units being independently operable, the bed unit comprises a plurality of groups of bed units arranged in such a way as to correspond to the respective head units, and the sewing frame comprises a plurality of sewing frames provided on the table so that the head units are able to independently conduct sewing operations on individual areas.

22. The sewing machine as set forth in claim 21, wherein each of the sewing frames has X-axial transport means and Y-axial transport means.

23. The sewing machine as set forth in claim 11, wherein the sewing frame comprises a plurality of sewing work areas, and objects are supported on the respective sewing work areas.

24. The sewing machine as set forth in claim 23, wherein the sewing frame comprises a plurality of subsidiary sewing frames provided on the single sewing frame so as to be individually removable therefrom.

25. The sewing machine as set forth in claim 23, wherein an indication is provided on the sewing frame, the indication containing information instructing about a working method, and reading means for scanning the indication is provided on the head unit, wherein the reading means reads the information contained in the indication and transmits the information to a control unit.

26. The sewing machine as set forth in claim 25, wherein the indication comprises a barcode, and the reading means comprises a barcode reader.

27. A method of controlling operation of a sewing machine that transports a sewing frame, holding an object to be sewed, in an X-axis or Y-axis direction and rotates a head unit and a bed unit around a Z-axis while sewing, the method comprising:

(a) positioning a sewing needle of the head unit above a needle plate;

(b) operating an X-axial transport motor, a Y-axial transport motor, a head unit rotating motor and a bed unit rotating motor in response to information input to a control unit;

(c) moving the sewing needle downwards by operation of an upper shaft drive motor and a lower shaft drive motor to form a stitch, and returning to (b) operating when the sewing needle is moved upwards and positioned above the needle plate, and repeating (b) operating and (c) moving.

28. The method as set forth in claim 27, wherein an rpm of the upper shaft drive motor and an rpm of the lower shaft drive motor are increased or reduced in proportion to rpms of the X-axial transport motor, the Y-axial transport motor, the head unit rotating motor and the bed unit rotating motor.

29. The method as set forth in claim 27, wherein after the rpm of the upper shaft drive motor and the rpm of the lower shaft drive motor are reduced, the head unit rotating motor and the bed unit rotating motor are operated.

30. The method as set forth in claim 27, wherein the rotating speed of the upper shaft drive motor and the rotating speed of the lower shaft drive motor are controlled in response to an angle at which the head unit and the bed unit rotate.

* * * * *